US011434621B2

(12) United States Patent
Uhlin et al.

(10) Patent No.: US 11,434,621 B2
(45) Date of Patent: Sep. 6, 2022

(54) METHOD FOR DETERMINING OBJECT POSITION INFORMATION

(71) Applicant: Volvo Construction Equipment AB, Eskilstuna (SE)

(72) Inventors: Erik Uhlin, Eskilstuna (SE); Johan Sjöberg, Västerås (SE)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 16/495,201

(22) PCT Filed: Mar. 20, 2017

(86) PCT No.: PCT/EP2017/056501
§ 371 (c)(1),
(2) Date: Sep. 18, 2019

(87) PCT Pub. No.: WO2018/171856
PCT Pub. Date: Sep. 27, 2018

(65) Prior Publication Data

US 2020/0141085 A1 May 7, 2020

(51) Int. Cl.
*E02F 3/43* (2006.01)
*E02F 3/96* (2006.01)
(Continued)

(52) U.S. Cl.
CPC ..... *E02F 3/434* (2013.01); *E02F 3/966* (2013.01); *E02F 9/262* (2013.01); *E02F 9/265* (2013.01); *E02F 3/3417* (2013.01)

(58) Field of Classification Search
CPC ..... E02F 3/3417; E02F 3/434; E02F 3/966; E02F 9/262; E02F 9/265
See application file for complete search history.

(56) References Cited

U.S. PATENT DOCUMENTS 5,592,092 A 1/1997 Mechler
6,427,780 B1 * 8/2002 Kimura ..... E02F 3/847 172/2
(Continued)

FOREIGN PATENT DOCUMENTS

CN 101652679 A 2/2010
CN 106066645 A 11/2016
(Continued)

OTHER PUBLICATIONS

International Search Report and Written Opinion of the International Searching Authority, PCT/EP2017/056501, dated Dec. 8, 2017, 12 pages.
(Continued)

*Primary Examiner* — Tyler J Lee
(74) *Attorney, Agent, or Firm* — Sage Patent Group

(57) ABSTRACT

A method for determining object position information indicative of the position includes at least the horizontal position of an object that is intended to be removed using an object removal machine. The method uses a working machine that includes an implement, and that is different from the object removal machine. The method includes arranging the implement such that at a position of at least a portion thereof has a determinable relation to the position of the object; determining the position of the implement, and determining the object position information using the position of the implement.

21 Claims, 4 Drawing Sheets

(51) Int. Cl.
*E02F 9/26* (2006.01)
*E02F 3/34* (2006.01)

(56) References Cited

U.S. PATENT DOCUMENTS

| | | | | |
|---|---|---|---|---|
| 7,532,967 | B2 * | 5/2009 | Fujishima | E02F 9/2045 37/341 |
| 8,766,639 | B2 * | 7/2014 | Branson | G01V 3/06 324/329 |
| 9,540,793 | B2 * | 1/2017 | Kami | G01C 21/165 |
| 2001/0045534 | A1 * | 11/2001 | Kimura | G01C 15/002 250/559.38 |
| 2004/0210370 | A1 | 10/2004 | Gudat et al. | |
| 2005/0027420 | A1 * | 2/2005 | Fujishima | E02F 9/2045 701/50 |
| 2015/0168136 | A1 | 6/2015 | Kamat et al. | |
| 2016/0244950 | A1 * | 8/2016 | Kami | G01C 15/00 |
| 2017/0315553 | A1 * | 11/2017 | Kadono | G05D 1/0285 |

FOREIGN PATENT DOCUMENTS

| | | | |
|---|---|---|---|
| JP | H0673755 | U | 10/1994 |
| WO | WO2015/123402 | A1 | 8/2015 |
| WO | 2016204660 | A1 | 12/2016 |

OTHER PUBLICATIONS

Chinese First Office Action dated Jul. 2, 2021 for Chinese Patent Application No. 201780088568.5, 16 pages (including English translation).
European Office Action dated May 23, 2022 for European Patent Application No. 17712101.9, 7 pages.

* cited by examiner

METHOD FOR DETERMINING OBJECT POSITION INFORMATION

CROSS REFERENCE TO RELATED APPLICATIONS

This application is a 35 U.S.C. § 371 national stage application of PCT International Application No. PCT/EP2017/056501 filed on Mar. 20, 2017, the disclosure and content of which is incorporated by reference herein in its entirety.

TECHNICAL FIELD

The invention relates to a method for determining object position information. Further, the present invention relates to a method for determining an object position information set. Moreover, the present invention relates to a method for removing an object using an object removal machine. Additionally, the present invention relates to a control unit for determining object position information.

The invention can be applied in various types of construction equipment. Although the invention will be described with respect to a wheel loader, the invention is not restricted to this particular vehicle, but may also be used in other types of working machines, such as for instance an excavator.

BACKGROUND

In various types to work sites, such as quarries, blasting may be performed in order to obtain rock portions that can be removed using working machines, such as for instance a wheel loader or an excavator. However, the blasting may result in rock portions that, owing to their size and/or weight, cannot be removed directly by the working machine normally performing the removing operation. Instead, other measures need to be taken.

For instance, a working machine with an enhanced loading capacity may be sent to the work site, for instance on a regular basis or upon request by an operator, in order to remove rock portions that cannot be removed using the normally used working machine.

As another alternative, a fragmenting machine comprising a fragmenting tool, such as a hydraulic hammer, may be sent to the work site, for instance on a regular basis or upon request by an operator, in order to fragment large rock portions into fragments that can be handled by the working machine normally performing the removing operations.

However, irrespective of how the large rock portions are removed, their removal generally involves the use of a specifically dedicated removal machine. The operation of such a specific machine is generally associated with considerable costs. As such, it would be beneficial to determine when it is worthwhile employing the specifically dedicated removal machine for an object removal assignment.

SUMMARY

An object of the invention is to provide a method that can be used for determining information relevant when making a decision if and/or how a specifically dedicated machine should be employed for removing objects from a work site.

The object is achieved by a device/method according to claim 1.

As such, the present invention relates to a method for determining object position information indicative of the position, comprising at least the horizontal position, of an object that is intended to be removed using an object removal machine. The method uses a working machine being different from the object removal machine and comprising an implement. The method comprises:

- arranging the implement such that at a position of at least a portion thereof has a determinable relation to the position of the object;
- determining the position of the implement, and
- determining the object position information using the position of the implement.

The above method implies that a working machine that for instance performs working operations at a work site may also be used for determining object position information for an object that is intended to be removed using an object removal machine. As such, the working machine may have at least two assignments at a work site: a first assignment of e.g. moving and/or removing material and a second assignment of determining object position information for an object that is intended to be removed using another object removal machine.

As used herein, the expression "determinable relation" is intended to encompass that the relation between the position of at least a portion of the implement and the position of the object is possible to determine. Purely by way of example, the relation may be determined by means of measurement, estimation or the like.

Moreover, by virtue of the fact that the method uses the implement of the working machine for determining the position of the object, there is generally no need to furnish the working machine with a dedicated position determining arrangement or the like.

Optionally, the method comprises positioning the working machine relative to the object such that the implement can be positioned adjacent to the object, preferably such the implement can reach and/or superimpose the object.

The above positioning implies a straightforward possibility to determine the position of the object.

Optionally, the feature of arranging the implement such that the position of at least a portion thereof has a determinable relation to the position of the object comprises arranging the implement such that the position of at least a portion of the implement corresponds to the position of the object.

Optionally, the feature of arranging the implement such that at a position of at least a portion thereof has a determinable relation to a position of the object comprises arranging the implement such that at least a portion of the implement is in contact with the object.

A contact between at least a portion of the implement and the object may have the advantage that the position of the object relative to the implement can be determined with an appropriately high degree of certainty. Moreover, the above contact may also be used for triggering the feature of determining the object position information using the position of the implement. As such, an operator of the working machine need not necessarily actuate another actuator, such as a button, lever or the like, in order to initiate the determination of the object position information.

Optionally, the method comprises determining a contact load imparted on the implement by the object, the method comprising determining that at least a portion of the implement is in contact with the object upon determination that the contact load exceeds a predetermined threshold load.

Using the information that a contact load exceeds a predetermined threshold load for determining that the implement is in contact with the object implies that an actual contact may be established with a relatively high degree of certainty.

Optionally, the working machine comprises a global positioning system and the feature of determining the position of the implement comprises employing the global positioning system.

A global positioning system implies an appropriate means for determining the position of the implement.

Optionally, the feature of determining the object position information using the position of the implement comprises setting the position of the object equal to the position of the implement.

Optionally, the object is a boulder. As used herein, the feature "boulder" relates to a rock fragment that is too large to be removed by the working machine. Purely by way of example, a "boulder" may be defined as a rock fragment with a weight exceeding 200 kg, preferably exceeding 500 kg.

Optionally, at least a portion of the boulder is located above ground.

Optionally, the method further comprises determining the size and/or weight of the object.

Information indicative of the size of the object may be useful in different contexts. For instance, the size of the object may be useful for the object removal machine and/or the operator of the object removal machine.

Optionally, the object is intended to be fragmented and the object removal machine is an object fragmentation machine.

A second aspect of the present invention relates to a method for determining an object position information set indicative of at least the horizontal position of each one of a plurality of objects that are intended to be removed using an object removal machine. The method comprises:

- for each one of the objects, determining object position information for that object using a method according to the first aspect of the present invention, and
- adding the object position information to the object position information set.

The above object position information set may be useful for instance for determining when the object removal machine should be activated in order to remove the set of objects. For instance, the object removal machine may be activated when the object position information set is indicative of that an appropriate number of objects and/or an appropriate total size and/or total weight of the set of objects is determined.

Optionally, the method further comprises issuing an object position signal, containing the object position information, from the working machine.

Optionally, the method comprises issuing the object position signal to the object removal machine.

A third aspect of the present invention relates to a method for removing an object using an object removal machine. The method comprises:

- receiving object position information that has been determined using the first and/or second aspect of the present invention,
- moving the object removal machine to the object using the object position information, and
- removing the object using the object removal machine.

The third step of the present invention implies that the object removal machine may be directed to the object(s) to be removed in an expedient manner. As such, the object removal machine and/or the operator of the object removal machine need not necessarily search for objects to be removed but can instead be guided to the previously determined positions of the objects to be removed.

Optionally, the feature of receiving object position information comprises receiving the object position information set that has been determined according to the second aspect of the present invention.

Receiving the above object position information set implies that the object removal machine may be used in an efficient manner for removing the objects.

Optionally, the method comprises determining a path for the object removal machine along which the object removal machine can be moved in order to be able to remove at least a plurality of the objects.

The determination of the above path implies that the object removal machine may be moved between the objects to be removed in a cost and/or time efficient manner.

Optionally, the method comprises determining the amount of objects in the object position information set. The above information may for instance be useful for determining when the object removal machine should be activated for removing objects from a work site.

Optionally, the method comprises determining the total size and/or total weight of the amount of objects in the object position information set. The total size and/or total weight may for instance be used as a trigger for determining when the object removal machine should be activated for removing objects from a work site.

Optionally, the object removal machine is a fragmenting machine comprising a fragmenting tool, preferably a hydraulic hammer, wherein the feature of removing the object comprises fragmenting the object by operating the fragmenting tool.

A fourth aspect of the present invention relates to a control unit for determining object position information indicative of the position, comprising at least the horizontal position, of an object intended to be removed using an object removal machine. The control unit is adapted to:

- receive a signal indicative of that at least a portion of an implement of a working machine, being different from the object removal machine, is in a position with a determinable relation to the position of the object;
- receive a signal indicative of the position of at least the portion of the implement, and
- determine the object position information using the position of the implement.

Optionally, the control unit is adapted to issue a signal so as to arrange the implement such that at a position of at least a portion thereof has a determinable relation to a position of the object.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1:
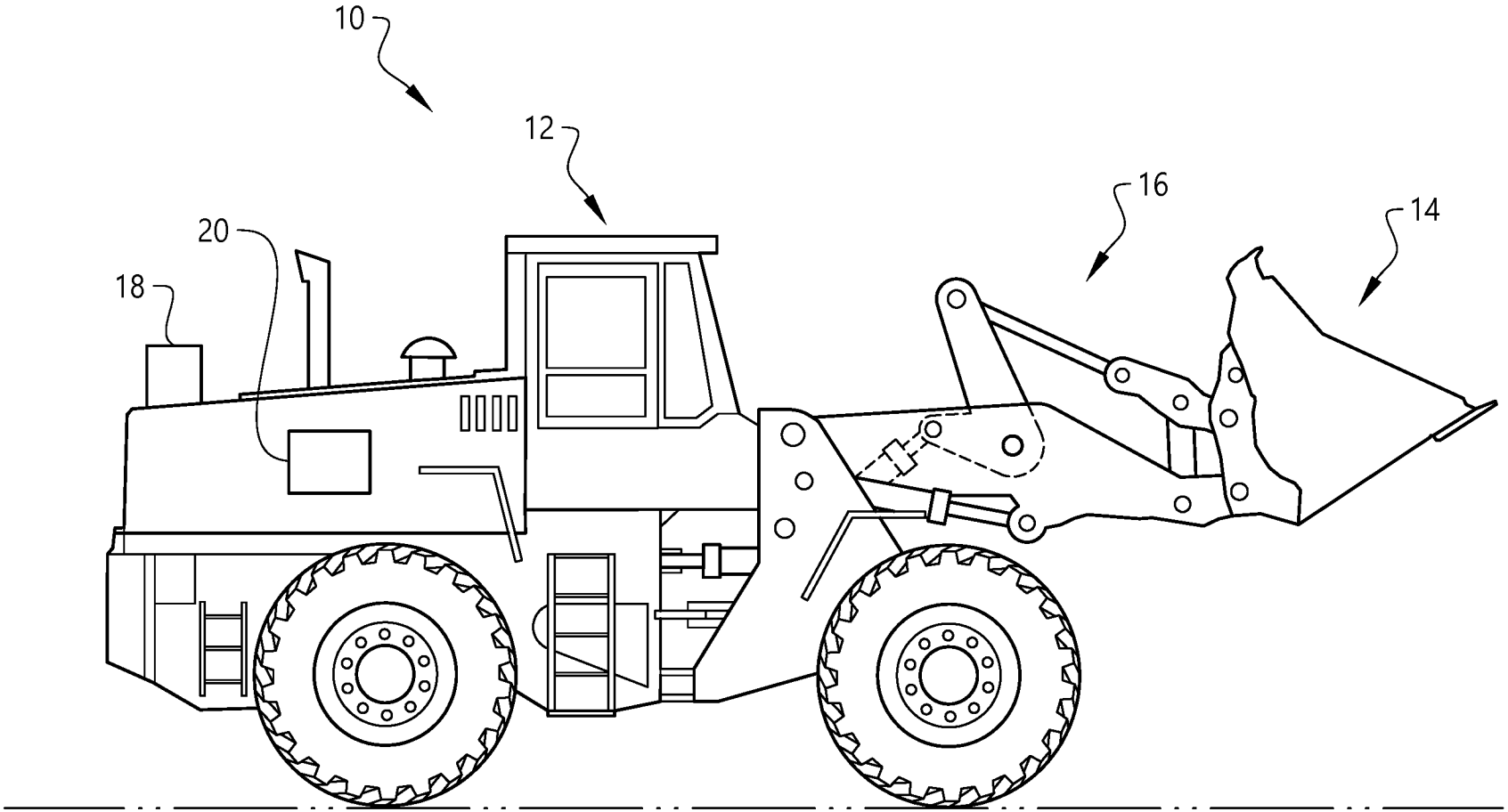
FIG. 1 illustrates a working machine.

FIG. 1 illustrates a working machine 10 comprising a main body 12 and an implement 14. Moreover, the working machine 10 comprises an actuating arrangement 16 for moving the implement 14 relative to the main body 12. Purely by way of example, the actuating arrangement 16 may comprise a hydraulic system and/or an electric system.

The FIG. 1 implementation of the working machine 10 is a wheel loader and the implement 14 is a bucket. However, other types of working machines are also envisaged. For instance, the working machine may be implemented as an excavator (not show in FIG. 1).

Moreover, the FIG. 1 working machine 10 comprises a global positioning system 18 adapted to determine the global position of at least a portion of the implement 14. Instead of or in addition to the global positioning system 18, the working machine 10 may comprise another type of system, such as a TERCOM system (terrain mapping, not shown), a land mark navigation system (not shown) or a celestial navigation system (not shown). Furthermore, the working machine 10 illustrated in FIG. 1 comprises a control unit 20 for determining object position information.

Figure 2:
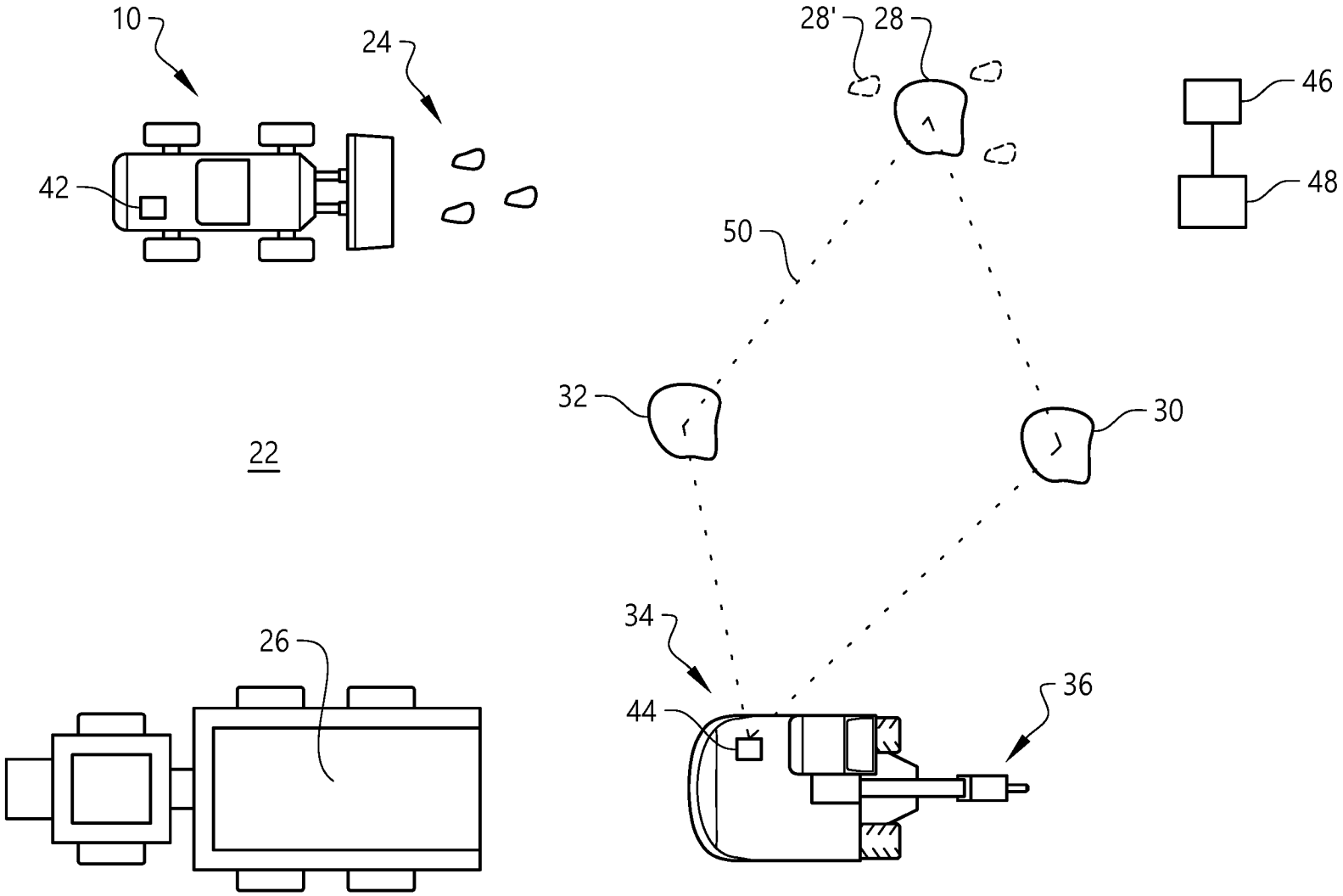
FIG. 2 is a top view of a work site with a working machine.

FIG. 2 is a top view of a work site 22 in which a working machine 10, for instance the FIG. 1 working machine 10, is operating in order to remove material from the work site 22. For instance, the work site 22 may be a quarry and the material to be removed from the quarry may be rock portions being the result from blasting in the quarry. However, it is also envisage that the work site 22 may be another type of work site than a quarry.

As may be gleaned from FIG. 2, the objects to be removed from the work site 22 may be of different sizes. For instance, certain objects 24 may be relatively small and can thus be removed by the working machine 10 itself. As a non-limiting example, such objects 24 may be moved by the working machine to an offloading site 26. Purely by way of example, the offloading site 26 may comprise a receptacle portion of another working machine, such as a hauler.

However, the work site 22 may also comprise objects 28, 30, 32 that cannot be moved by the working machine 10 itself. For instance, each one of the objects 28, 30, 32 may be too large and/or too heavy to be lifted by the implement 14 of the working machine 10.

If the object that cannot be moved by the working machine 10 is of rock material, the object may be referred to as a boulder. Purely by way of example, a "boulder" may be defined as a rock fragment with a weight exceeding 200 kg, preferably exceeding 500 kg. As another non-limiting example, at least a portion of such a boulder may be located above ground such that it is visible by an operator of the working machine 10.

In order to be able remove the objects 28, 30, 32 that cannot be removed by the working machine 10, a separate object removal machine 34 may be employed for assisting in the removal thereof.

Purely by way of example, and as is indicated in FIG. 2, the separate object removal machine 34 may be a fragmenting machine comprising a fragmenting tool 36, preferably a hydraulic hammer. As such, the object removal machine 34 may in such an example remove the objects 28, 30, 32 by fragmenting the object by operating the fragmenting tool 36. This is illustrated in FIG. 2 wherein one of the objects 28 that cannot be removed by the working machine 10 has been fragmented into smaller portions 28'. Such smaller portions 28' may subsequently be removed by the working machine 10.

As another example, the separate object removal machine 34 may be a large capacity working machine having a loading capacity exceeding the loading capacity of the working machine 10. Purely by way of example, such a large capacity working machine may be able to remove an object of at least twice the weight of the heaviest object that the working machine 10 can remove on its own.

Irrespective of the separate object removal machine 34, it is desired that the separate object removal machine 34 or the operator thereof be informed about the position of each one of the objects 28, 30, 32 that cannot be removed by the working machine 10.

Figure 3:
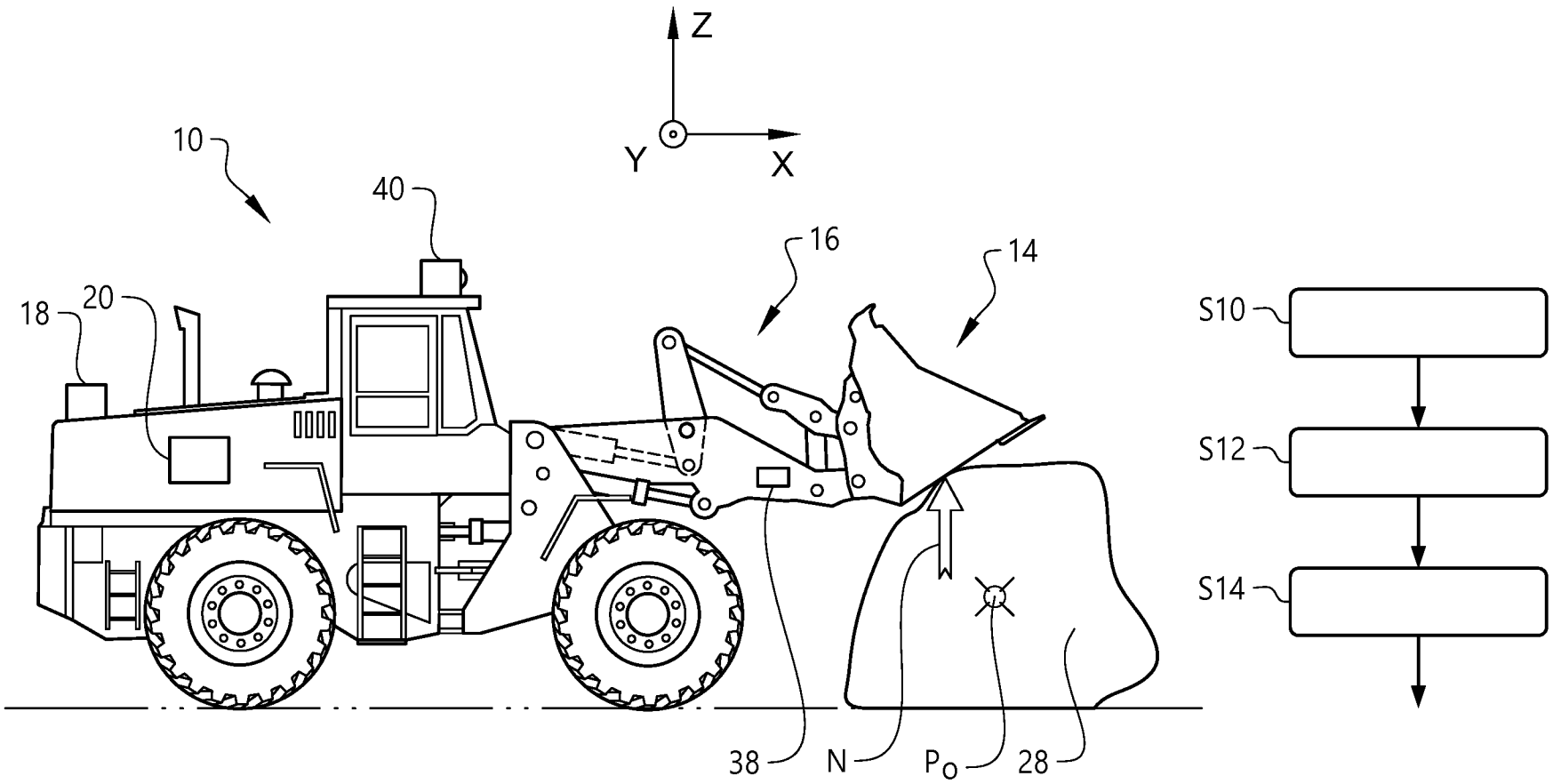
FIG. 3 is a side view of a working machine and an object illustrating a method embodiment of the present invention.

To this end, with reference to FIG. 3, the present invention proposes a method for determining object position information indicative of the position $P_{\bigcirc}$, comprising at least the horizontal position, of an object 28 that is intended to be removed using an object removal machine. In FIG. 3, a global coordinate system X, Y, Z is indicated and wherein each one of the axes X and Y extend in a horizontal plane. As such, the method according to the present invention determines at least the X and Y coordinates of the object 28.

As may be gleaned from FIG. 3, the method uses the working machine 10 that is intended to remove material from the works site 22, which working machine 10 is different from the object removal machine (not shown in FIG. 3) that is intended to be used for removing the object 28. Purely by way of example, the method may be carried out using the a control unit 20 of the working machine 10.

FIG. 3 further illustrates that the method comprises:

- S10: arranging the implement 14 of the working machine 10 such that at a position of at least a portion thereof has a determinable relation to the position of the object 28;
- S12: determining the position of the implement 14, and
- S14: determining the object position information using the position of the implement 14.

Each one of the steps S10, S12 and S14 will be elaborated on hereinbelow.

As regards step S10, the arrangement of the implement 14 relative to the object 28 may be achieved in a plurality of ways.

For instance, and as indicated in the FIG. 3 example, the method according to the present invention may comprise positioning the working machine 10 relative to the object 28 such that the implement 14 can be positioned adjacent to the object 28. Preferably, the working machine 10 is positioned relative to the object 28 such the implement 14 can reach and/or superimpose the object 28.

Furthermore, and as exemplified in FIG. 3, arranging the implement 14 such that the position of at least a portion thereof has a determinable relation to the position of the object 28 may comprise arranging the implement 14 such that the position of at least a portion of the implement 14 corresponds to the position of the object 28. For instance, the implement 14 may be positioned above the object 28 without necessarily touching the object 28. Optionally, the implement 14 may be moved relative to the object 28 in order to determine also the extension of the object along at least one axis. As such, the position as well as the extension of the object 28 may be determined.

As another example, and as is indicated in FIG. 3, the implement 14 may be arranged such that at least a portion of the implement 14 is in contact with the object 28. In order to determine that a contact is established between least a portion of the implement 14 and the object 28, a contact load N imparted on the implement 14 by the object may be determined. Purely by way of example, the magnitude of the contact load N may be determined using a load sensor 38 being arranged relative to the implement 14. As another option, the actuating arrangement 16 may be used for determining the contact load N imparted on the implement 14.

Irrespective of how the contact load is determined, the method may comprise determining that at least a portion of the implement 14 is in contact with the object 28 upon determination that the contact load N exceeds a predetermined threshold load. Purely by way of example, the predetermined threshold load may be related to the weight of the implement 14.

Purely by way of example, and as is indicated in the FIG. 3 embodiment, the feature of determining the object position information using the position of the implement 14 may comprise setting the position of the object 28 equal to the position of the implement 14.

Moreover, though purely by way of example, the method according to the present invention may further comprise determining the size of the object 28. To this end, and as indicated in FIG. 3, the working machine 10 may for instance comprise an image sensor 40, such as a camera, adapted to capture an image of the object 28. From the image thus generated, it may be possible to determine the size of the object 28. Moreover, once the size of the object 28 has been determined, the weight of the object 28 may be estimated. For instance, the weight may be estimated by estimating the density of the material of the object 28. Purely by way of example, such a density estimate may be performed by using information indicative of the type of rock present at the work site 22. As another option, the density estimate may be based on weight and size estimates of material that has previously been removed by the working machine 10.

Figure 4:
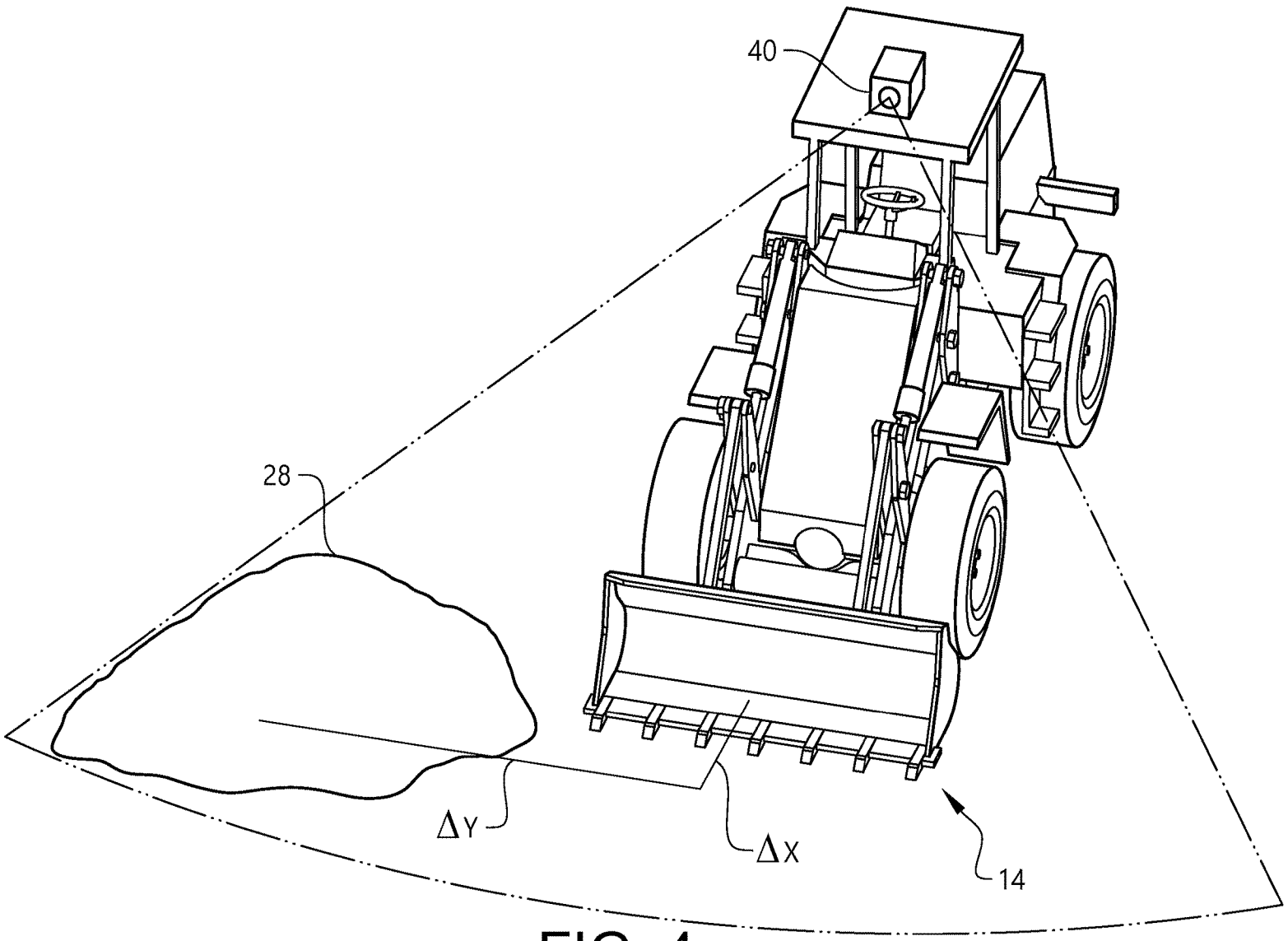
FIG. 4 is a perspective view of a working machine and an object illustrating another method embodiment of the present invention.

FIG. 4 illustrates another implementation of the procedure for determining the position of the object 28. In the FIG. 4 implementation, the implement 14 need not necessarily contact the object 28 or even be located such that it can reach and/or superimpose the object 28. Instead, the implement 14 is located at determinable, e.g. measurable, horizontal distance from the object 28. Purely by way of example, and as is indicated in FIG. 4, such a horizontal distance may be a longitudinal distance $\Delta X$ as well as a transversal distance $\Delta Y$ from the centre of the implement 14 to the centre of the object 28.

Irrespective of how the horizontal distance between the implement 14 and the object 28 is defined, the horizontal distance may for instance be determined using the image sensor 40, such as a camera, which may capture an image of the implement 14 and the object 28 and from the thus generated image determine the horizontal distance between the implement 14 and the object 28. It is also envisaged that the horizontal distance may be determined using other distance determining means, such as a laser sensor (not shown).

The object position information determination method presented hereinabove may preferably be performed for each object 28, 30, 32 at a work site 22 that that is intended to be removed using an object removal machine 34.

As such, again with reference to FIG. 2, a second aspect of the present invention relates to a method for determining an object position information set indicative of at least the horizontal position of each one of a plurality of objects 28, 30, 32 that are intended to be removed using an object removal machine 34. The method comprises:

for each one of the objects 28, 30, 32, determining object position information for that object, for instance using any one of the method embodiments that have been presented hereinabove with reference to FIG. 3 or FIG. 4, and adding the object position information to the object position information set.

As such, with reference to FIG. 2, the working machine 10 may be moved to each one of the objects 28, 30, 32 and at least the horizontal position of each one of the objects may be determined and added to the above-mentioned object position information set.

Irrespective of whether at least the horizontal position of only one object 28 has been determined or if the above-mentioned object position information set has been determined, the method of the present invention may comprise issuing an object position signal, containing the object position information or the object position information set, from the working machine 10. To this end, and as is indicated in FIG. 2, the working machine 10 may comprise a signal transmitter 42 adapted to transmit the above object position signal.

Purely by way of example, and as indicated in FIG. 2, the object position signal may be issued directly to the object removal machine 34. To this end, the object removal machine 34 may comprise a signal receiver 44 adapted to receive signals from the signal transmitter 42.

However, instead of, or in addition to, transmitting the signal to the signal receiver 44 of the object removal machine 34, the signal transmitter 42 may be adapted to transmit the signal to another signal receiver, such as a communication device 46 associated with a separate signal processing device 48. Purely by way of example, the separate signal processing device 48 need not necessarily be located at or adjacent to the work site 22. Instead, the separate signal processing device 48 may be located remote from the work site 22. Purely by way of example, the communication device 46 associated with the separate signal processing device 48 may be adapted to transmit signals to the signal receiver 44 of the object removal machine 34.

As such, the signals issued by the signal transmitter 42 may for instance be processed by the separate signal processing device 48 or by the object removal machine 34.

Irrespective of how the object position information has been forwarded and processed from the working machine 10 to the object removal machine 34, the information may be used in a method for removing an object 28 using the object removal machine 34. Such a method comprises:

receiving object position information that has been determined using the first and/or second aspect of the present invention, for instance as exemplified hereinabove with reference to FIG. 3 or FIG. 4, moving the object removal machine 34 to the object 28 using the object position information, and removing the object 28 using the object removal machine 34.

Purely by way of example, the above feature of receiving object position information may comprise receiving the object position information set that has been determined according to the second aspect of the present invention. The above object position information set may be useful in many ways.

Purely by ways of example, and with reference to FIG. 2, the object position information set may be useful for determining a path 50 for the object removal machine 34 along which the object removal machine 34 can be moved in order to be able to remove at least a plurality of the objects 28, 30, 32. As a non-limiting example, the path 50 may be determined as a path along which the object removal machine 34 can be moved such that it reaches each one of the objects 28, 30, 32 whilst travelling a distance below a threshold distance, preferably whilst travelling at a minimum possible distance. As such, the above path 50 determination implies savings in for instance fuel consumption of the object removal machine 34.

Moreover, the above method may further comprise determining the amount of objects 28, 30, 32 in the object position information set. Instead of, or in addition to determining the amount of objects 28, 30, 32 in the object position information set, the method may comprise determining the total size and/or total weight of the objects in the object position information set.

Purely by way of example, any one or more of the above entities: the amount of objects 28, 30, 32, the total size of the objects 28, 30, 32 and the total weight of the objects 28, 30, 32 may be used for determining if the object removal machine 34 should be activated for removing objects 28, 30, 32 from the work site 22. Purely by way of example, the object removal machine 34 may be put in a stand-by condition until any one of the above entities exceeds a predetermined threshold value. In this way, it may be ensured that the object removal machine 34 is only used when necessary.

Furthermore, when an object 28 has been removed using the object removal machine 34, the method may comprise an indication that the object 28 has been removed. For instance, when the object removal machine 34 has received an object position information set, the physically removed object 28 may also be removed from the object position information set. Additionally, the object removal machine 34 may also be adapted to determine the size and/or weight of the object 28 that has been removed. Purely by way of example, information indicative of the fact that the object has been removed from the object position information set and/or the size and/or weight of the object that has been removed 28 may be subsequently used.

For instance, the size and/or weight of the object 28 may be used for evaluating the quality of the work site, for instance the quality of the blasting that has occurred in a quarry.

It is to be understood that the present invention is not limited to the embodiments described above and illustrated in the drawings; rather, the skilled person will recognize that many changes and modifications may be made within the scope of the appended claims.

The invention claimed is:

1. A method for determining object position information indicative of a position, comprising at least a horizontal position, of an object to be removed using an object removal machine, said method using a working machine being different from said object removal machine and comprising an implement, said method comprising:

arranging said implement of said working machine such that at a position of at least a portion thereof has a determinable relation to the position of said object;

determining the position of said implement of said working machine; and determining said object position information using said position of said implement of said working machine, wherein said working machine comprises a global positioning system and wherein determining the position of the implement comprises employing said global positioning system.

2. The method according to claim 1, further comprising positioning said working machine relative to said object such that said implement can be positioned adjacent to said object.

3. The method according to claim 1, wherein arranging the implement such that the position of at least a portion thereof has a determinable relation to the position of said object comprises arranging the implement such that the position of at least a portion of said implement corresponds to the position of said object.

4. The method according to claim 1, wherein arranging the implement such that at a position of at least a portion thereof has a determinable relation to a position of said object comprises arranging the implement such that at least a portion of said implement is in contact with said object.

5. A method for determining object position information indicative of a position, comprising at least a horizontal position, of an object to be removed using an object removal machine, said method using a working machine being different from said object removal machine and comprising an implement, said method comprising:

arranging said implement of said working machine such that at a position of at least a portion thereof has a determinable relation to the position of said object;

determining the position of said implement of said working machine; and determining said object position information using said position of said implement of said working machine, the method further comprising determining a contact load imparted on said implement by said object, said method comprising determining that at least a portion of said implement is in contact with said object upon determination that said contact load exceeds a predetermined threshold load.

6. A method for determining object position information indicative of a position, comprising at least a horizontal position, of an object to be removed using an object removal machine, said method using a working machine being different from said object removal machine and comprising an implement, said method comprising:

arranging said implement of said working machine such that at a position of at least a portion thereof has a determinable relation to the position of said object;

determining the position of said implement of said working machine; and determining said object position information using said position of said implement of said working machine, wherein determining said object position information using said position of said implement comprises setting the position of said object equal to said position of said implement.

7. A method for determining object position information indicative of a position, comprising at least a horizontal position, of an object to be removed using an object removal machine, said method using a working machine being different from said object removal machine and comprising an implement, said method comprising:

arranging said implement of said working machine such that at a position of at least a portion thereof has a determinable relation to the position of said object;

determining the position of said implement of said working machine; and determining said object position information using said position of said implement of said working machine, wherein said object is a boulder.

8. The method according to claim 7, wherein at least a portion of said boulder is located above ground.

9. A method for determining object position information indicative of a position, comprising at least a horizontal position, of an object to be removed using an object removal machine, said method using a working machine being different from said object removal machine and comprising an implement, said method comprising:

arranging said implement of said working machine such that at a position of at least a portion thereof has a determinable relation to the position of said object;

determining the position of said implement of said working machine; and determining said object position information using said position of said implement of said working machine, the method further comprising determining at least one of a size and a weight of said object.

10. A method for determining object position information indicative of a position, comprising at least a horizontal position, of an object to be removed using an object removal machine, said method using a working machine being different from said object removal machine and comprising an implement, said method comprising:

arranging said implement of said working machine such that at a position of at least a portion thereof has a determinable relation to the position of said object;

determining the position of said implement of said working machine; and determining said object position information using said position of said implement of said working machine, wherein said object removal machine is an object fragmentation machine configured to fragment said object.

11. The method according to claim 1, wherein the object comprises a plurality of objects, and wherein determining said object position information comprises determining said object position information for each of said plurality of objects, said method further comprising:

adding said object position information for each of said plurality of objects to said object position information set.

12. The method according to claim 1, further comprising issuing an object position signal, containing said object position information, from said working machine.

13. The method according to claim 1, further comprising issuing said object position signal to said object removal machine.

14. The method according to claim 1, further comprising:

receiving said object position information, moving said object removal machine to said object using said object position information, and removing said object using said object removal machine.

15. The method according to claim 14, wherein receiving object position information comprises receiving said object position information set.

16. The method according to claim 1, further comprising determining a path for said object removal machine along which said object removal machine can be moved in order to be able to remove at least a plurality of said objects.

17. The method according to claim 1, further comprising determining an amount of objects in said object position information set.

18. The method according to claim 17, further comprising determining at least one of a total size and a total weight of the amount of objects in said object position information set.

19. The method according to claim 1, wherein said object removal machine is a fragmenting machine comprising a fragmenting tool, and wherein removing said object comprises fragmenting said object by operating said fragmenting tool.

20. A control unit for determining object position information indicative of the position, comprising at least the horizontal position, of an object intended to be removed using an object removal machine, said control unit being adapted to:

receive a signal indicative of that at least a portion of an implement of a working machine, being different from said object removal machine, is in a position with a determinable relation to the position of said object;

receive a signal indicative of the position of at least said portion of said implement of said working machine; and determine said object position information using said position of said implement of said working machine, wherein said working machine comprises a global positioning system and wherein determining the position of the implement comprises employing said global positioning system.

21. The control unit according to claim 20, wherein said control unit is adapted to issue a signal so as to arrange the implement such that at a position of at least a portion thereof has a determinable relation to a position of said object.

* * * * *